US006761539B2

(12) United States Patent
Cipelletti et al.

(10) Patent No.: US 6,761,539 B2
(45) Date of Patent: Jul. 13, 2004

(54) ROTOR BLADE WITH A REDUCED TIP

(75) Inventors: Giorgio Roberto Cipelletti, Borne (NL); Hendrik Fedde van der Spek, Delden (NL)

(73) Assignee: Ventilatoren Sirocco Howden B.V., Hengelo (NL)

( * ) Notice: Subject to any disclaimer, the term of this patent is extended or adjusted under 35 U.S.C. 154(b) by 0 days.

(21) Appl. No.: 10/202,497

(22) Filed: Jul. 24, 2002

(65) Prior Publication Data

US 2004/0018090 A1 Jan. 29, 2004

(51) Int. Cl.[7] ..... F04D 29/38
(52) U.S. Cl. ..... 416/228
(58) Field of Search ..... 416/228, 235, 416/236 R, 223 R, 92; 415/173.1, 173.6

(56) References Cited

U.S. PATENT DOCUMENTS 4,390,320 A * 6/1983 Eiswerth ..... 416/97 R
5,476,363 A * 12/1995 Freling et al. ..... 415/173.1
5,927,946 A * 7/1999 Lee ..... 416/97 R
6,206,642 B1 * 3/2001 Matheny et al. ..... 416/230

* cited by examiner

*Primary Examiner*—Ninh H. Nguyen
(74) *Attorney, Agent, or Firm*—Webb Ziesenheim Logsdon Orkin & Hanson, P.C.

(57) ABSTRACT

A rotor blade for a fan, said rotor blade comprising a first blade zone having an airfoil cross-section and a second blade zone having a cross-section of reduced thickness, wherein the average thickness of the second blade zone is less than 50% of the average thickness of the first blade zone.

19 Claims, 5 Drawing Sheets

ROTOR BLADE WITH A REDUCED TIP

BACKGROUND OF THE INVENTION

1) Field of the Invention

The invention relates to a rotor blade for a fan. Such fans are used for cooling and have a typical diameter which could amount up to 10 meters. Such fans comprise a hub on to which several rotor blades are mounted. Concentrically to this hub a housing is arranged, to direct the airflow which is generated by the rotation of the rotor blades.

2) Description of the Prior Art

The aerodynamic pressure generated locally by a rotor blade is proportional to the lift coefficient and to the square of the airspeed. At the tip, i.e. the free-end of the rotor blade, the aerodynamic pressure could be as high as 1500–2000 Pa.

The clearance between the tip and the housing is kept small in order to avoid "leakage" of the fan. As this tip clearance is small, the aerodynamic pressure generated at the tip of the blades is reacted onto the housing on a certain defined area. This area is proportional to the cordlength of the rotor blade and to the thickness at the tip of the blade. As the rotor blade rotates, and the housing is stationary, a high amplitude pulsating force is exerted onto the housing. This can result in fatigue cracks and/or failure of the housing, premature wear of the fan drive system and additional noise.

According to the prior art the disadvantages are at least partly eliminated by providing a stiff housing and/or support structure, or by increasing the number of fan blades. Both solutions result in an increase of the costs of a cooling unit.

It is therefore an object to provide a low cost solution relative to the solutions of the prior art.

SUMMARY OF THE INVENTION

This object is achieved by a rotor blade according to the invention, which blade comprises a first blade zone having an airfoil cross-section and a second blade zone having a cross-section of reduced thickness, wherein the average thickness of the second blade zone is less than 50% of the average thickness of the first blade zone.

By reducing the average thickness of the second blade zone, the area is reduced onto which the aerodynamic pressure is reacted. Therefore the pulse force is reduced which results in improvement of the fatigue life of the housing, reduction of the vibrations, reduction of the wear of the fan drive system and provides a solution at reduced costs.

In an embodiment of the rotor blade according to the invention, the length of the second blade zone is less than 15% of the length of the first blade zone.

Preferably, the length of the second blade zone is in the range of 0,05–0,6 of the average chord length of the first blade zone. Tests have revealed that these features provide for the desired reduction in the force exerted onto the housing, while keeping a sufficient performance.

In another preferred embodiment of the rotor blade according to the invention, the average thickness of the second blade zone is in the range of 0,02–0,2 of the average thickness of the first blade zone.

The thickness of a rotor blade is defined as the maximum thickness of a transversal cross-section of the rotor blade.

In again another preferred embodiment of the invention the mean line of the cross section of the second zone is substantially parallel to mean line of the cross section of the first zone. This provides for a similar air flow over the full length of the rotor blade.

In again another embodiment of the rotor blade according to the invention the upper surface of the second blade zone is substantially in line with the upper surface of the first blade.

BRIEF DESCRIPTION OF THE DRAWINGS

These and other advantages of the invention will be elucidated in conjunction with the accompanying drawings.

DETAILED DESCRIPTION OF THE PREFERRED EMBODIMENTS

Figure 1:
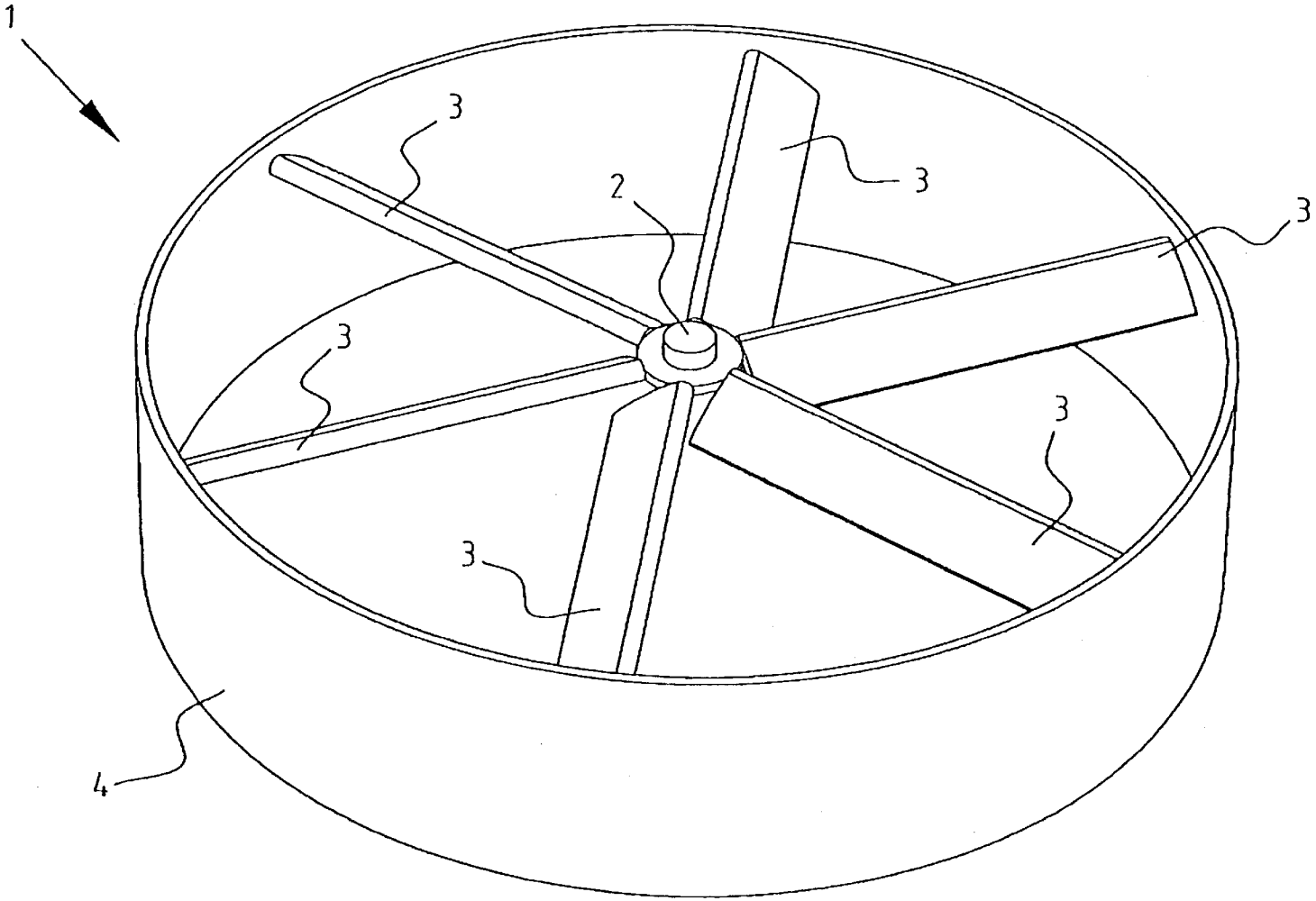
FIG. 1 shows a schematic perspective view of a fan with rotor blades according to the invention.

In FIG. 1 a fan 1 is shown. This fan 1 has a hub 2 onto which a number of rotor blades 3 are mounted. Concentrically to the hub 2 a housing 4 is arranged.

Figure 2A:
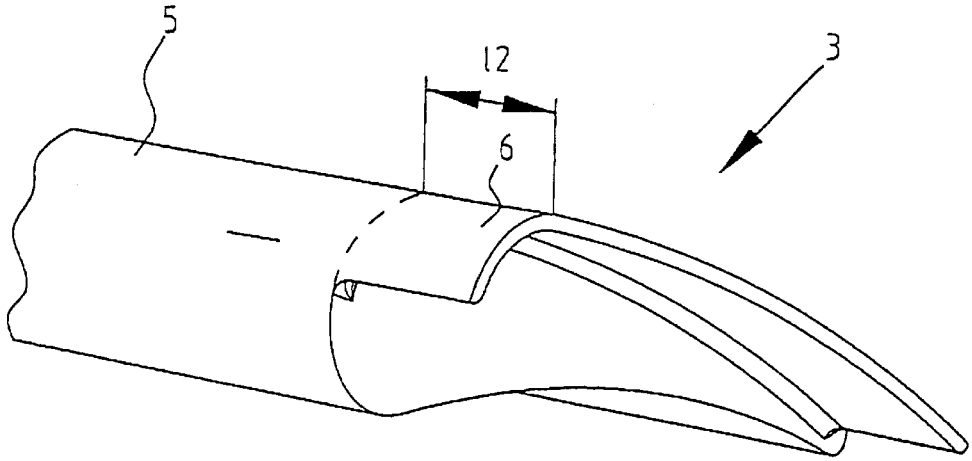
FIGS. 2*a* and 2*b* show a first embodiment of a rotor blade according to the invention.
Figure 2B:
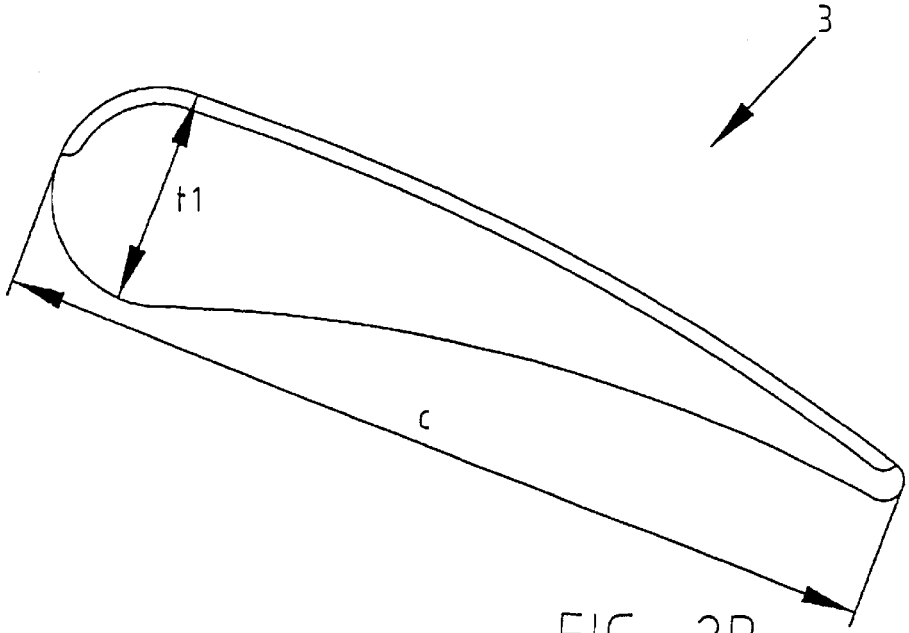

In FIGS. 2*a* and 2*b* the rotor blades 3 according to FIG. 1 are shown in more detail. The rotor blade 3 has a first blade zone 5 and a second blade zone 6. The upper surface of both blade zones are in line with each other. In FIG. 2*b* the thickness T1 of the first blade zone 5 is shown. The thickness of the second blade zone is preferably 0,02–0,2 T1. If the thickness of the rotor blade varies over the length of the rotor blade, then the average thickness is used. The length L2 of the second blade zone 6 is preferably 0,05–0,6 the cord length c of the first blade zone 5.

Figure 3A:
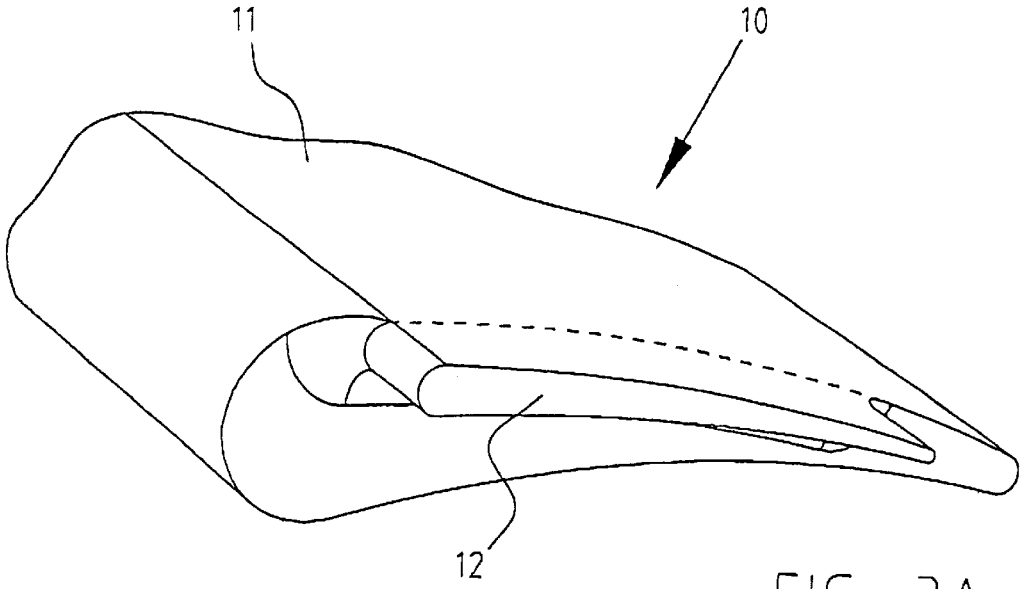
FIGS. 3*a* and 3*b* show a second embodiment of a rotor blade according to the invention.
Figure 3B:
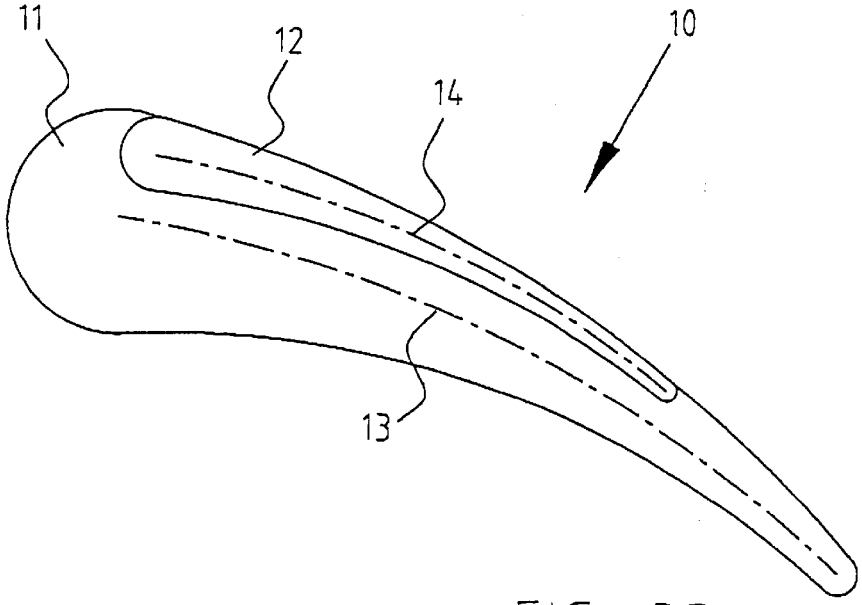

In FIGS. 3*a* and 3*b* a second embodiment of a rotor blade 10 according to the invention is shown. Again this rotor blade 10 has a first blade zone 11 and a second blade zone 12. In the previous embodiment the second blade zone is of a constant thickness, wherein the second blade zone 12 has in this embodiment an air foil shaped cross section. The mean line 13 of the first blade zone 11 and the mean line 14 of the second blade zone 12 are parallel to each other.

Figure 4A:
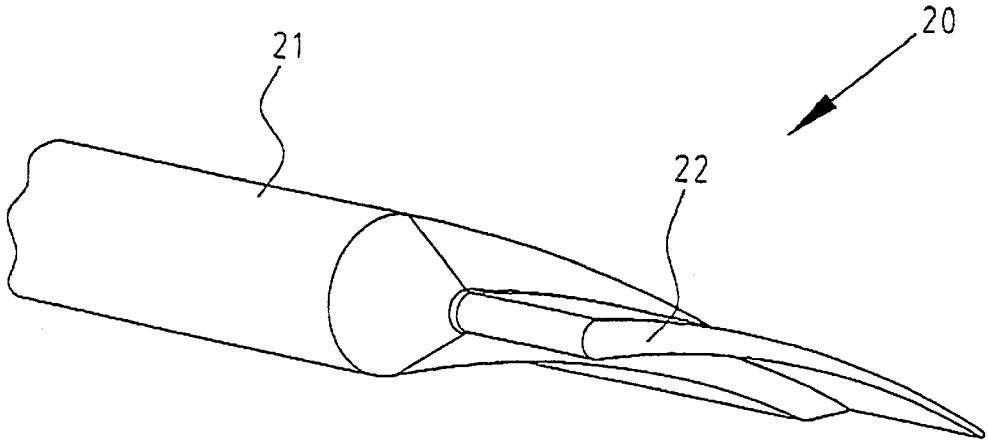
FIGS. 4*a* and 4*b* show a third embodiment of a rotor blade according to the invention.
Figure 4B:
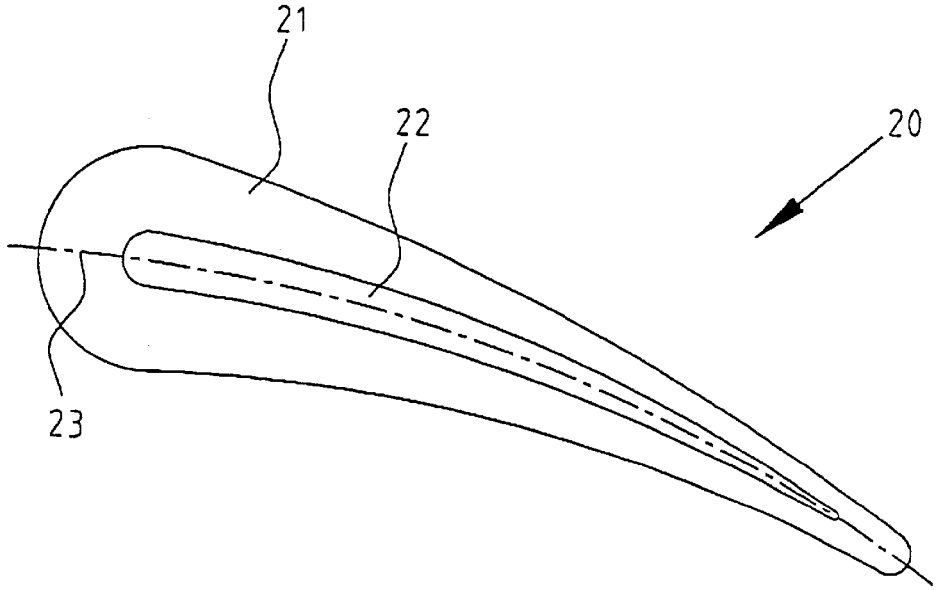

FIGS. 4*a* and 4*b* show a third embodiment 20 of a fan blade according to the invention. The rotor blade 20 has a first blade zone 21 and a second blade zone 22. The second blade zone 22 has an air foil cross section and the mean line of the first blade zone 21 corresponds to the mean line of the second blade zone 22. Also in this embodiment the second blade zone can have constant thickness as well.

Figure 5:
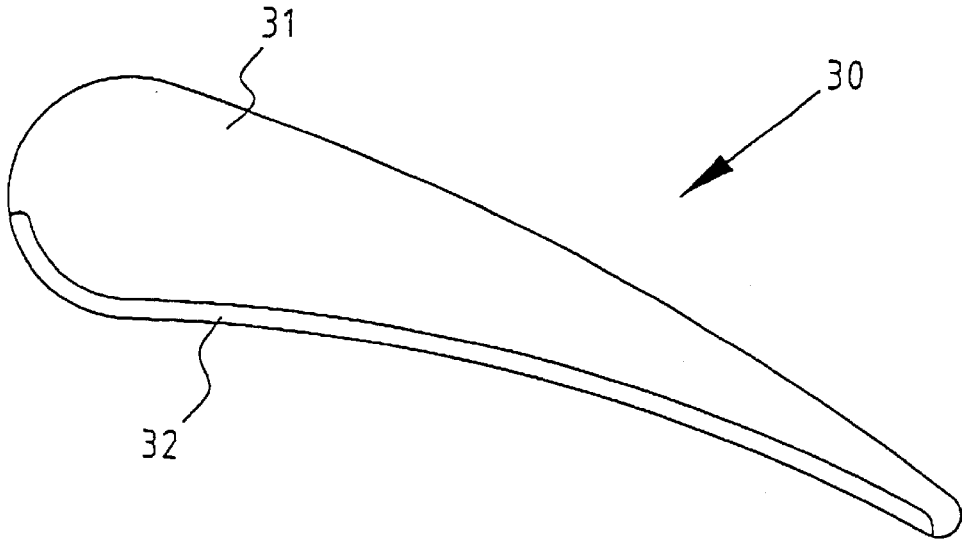
FIG. 5 shows a fifth embodiment of a rotorblade according to the invention.

FIG. 5 shows a fifth embodiment of a rotor blade 30 according to the invention. The first blade zone 31 has an airfoil cross-section. The second blade zone 32 at the tip of the blade 30 is reduced in thickness. The bottom surface of the second blade zone 32 is in line with the first blade zone 31.

What is claimed is:

1. A driven rotor blade for a fan for generating airflow, said rotor blade comprising a first blade zone having an airfoil cross-section and a second blade zone having a cross-section of reduced thickness, a closed free end and an upper surface substantially in line with an upper surface of the first blade zone, wherein the average thickness of the second blade zone is less than 50% of the average thickness of the first blade zone.

2. The rotor blade according to claim 1, wherein the length of the second blade zone is less than 50% of the length of the first blade zone.

3. The rotor blade according to claim 2, wherein the length of the second blade zone is in the range of 0.05–0.6 of the average cord length of the first blade zone.

4. The rotor blade according to claim 2, wherein the average thickness of the second blade zone is in the range of 0.02–0.2 of the average thickness of the first blade zone.

5. The rotor blade according to claim 2, wherein a mean line of the cross-section of the second zone is substantially parallel to a mean line of the cross-section of the first zone.

6. The rotor blade according to claim 2, wherein an upper surface of the second blade zone is substantially in line with an upper surface of the first blade zone.

7. The rotor blade according to claim 1, wherein the length of the second blade zone is in the range of 0.05–0.6 of the average cord length of the first blade zone.

8. The rotor blade according to claim 7, wherein the average thickness of the second blade zone is in the range of 0.02–0.2 of the average thickness of the first blade zone.

9. The rotor blade according to claim 7, wherein a mean line of the cross-section of the second zone is substantially parallel to a mean line of the cross-section of the first zone.

10. The rotor blade according to claim 7, wherein an upper surface of the second blade zone is substantially in line with an upper surface of the first blade zone.

11. The rotor blade according to claim 1, wherein the average thickness of the second blade zone is in the range of 0.02–0.2 of the average thickness of the first blade zone.

12. The rotor blade according to claim 11, wherein a mean line of the cross-section of the second zone is substantially parallel to a mean line of the cross-section of the first zone.

13. The rotor blade according to claim 11, wherein an upper surface of the second blade zone is substantially in line with an upper surface of the first blade zone.

14. The rotor blade according to claim 1, wherein a mean line of the cross-section of the second zone is substantially parallel to a mean line of the cross-section of the first zone.

15. The rotor blade according to claim 14, wherein an upper surface of the second blade zone is substantially in line with an upper surface of the first blade zone.

16. The rotor blade according to claim 1, wherein an upper surface of the second blade zone is substantially in line with an upper surface of the first blade zone.

17. A rotor blade for a fan, said rotor blade comprising a first blade zone having an airfoil cross-section and a second blade zone having a cross-section of reduced thickness, wherein the average thickness of the second blade zone is less than 50% of the average thickness of the first blade zone, wherein the length of the second blade zone is less than 50% of the length of the first blade zone, wherein the length of the second blade zone is in the range of 0.05–0.6 of the average cord length of the first blade zone, wherein the average thickness of the second blade zone is in the range of 0.02–0.2 of the average thickness of the first blade zone, wherein a mean line of the cross-section of the second zone is substantially parallel to a mean line of the cross-section of the first zone, and wherein an upper surface of the second blade zone is substantially in line with an upper surface of the first blade zone.

18. A rotor blade for a fan, said rotor blade comprising a first blade zone having an airfoil cross-section and a second blade zone having a cross-section of reduced thickness, wherein the average thickness of the second blade zone is less than 50% of the average thickness of the first blade zone, wherein the length of the second blade zone is in the range of 0.05–0.6 of the average cord length of the first blade zone, and wherein an upper surface of the second blade zone is substantially in line with an upper surface of the first blade zone.

19. A rotor blade for a fan, said rotor blade comprising a first blade zone having an airfoil cross-section and a second blade zone having a cross-section of reduced thickness, wherein the average thickness of the second blade zone is less than 50% of the average thickness of the first blade zone, wherein a mean line of the cross-section of the second zone is substantially parallel to a mean line of the cross-section of the first zone, and wherein an upper surface of the second blade zone is substantially in line with an upper surface of the first blade zone.

* * * * *